US007243930B1

(12) United States Patent
Wakley

(10) Patent No.: US 7,243,930 B1
(45) Date of Patent: Jul. 17, 2007

(54) INLINE SKATEBOARD ASSEMBLY

(76) Inventor: Robert Wakley, 455 Elm Ave., Woodbury Heights, NJ (US) 08097

( * ) Notice: Subject to any disclaimer, the term of this patent is extended or adjusted under 35 U.S.C. 154(b) by 221 days.

(21) Appl. No.: 10/645,464

(22) Filed: Aug. 21, 2003

Related U.S. Application Data

(60) Provisional application No. 60/405,029, filed on Aug. 21, 2002.

(51) Int. Cl.
*B62M 1/00* (2006.01)

(52) U.S. Cl. ..... 280/87.042; 280/11.221; 280/11.27

(58) Field of Classification Search ..... 280/87.041, 280/87.042, 11.231, 11.223, 11.19, 11.221, 280/11.222, 11.27, 842, 843, 11.225, 14.22, 280/11.233
See application file for complete search history.

(56) References Cited

U.S. PATENT DOCUMENTS 4,382,605 A * 5/1983 Hegna ..... 280/11.225
5,419,570 A 5/1995 Bollotte
5,601,299 A 2/1997 Yun et al.
5,660,401 A * 8/1997 Yi ..... 280/11.225
6,193,249 B1 * 2/2001 Buscaglia ..... 280/87.042
6,196,558 B1 * 3/2001 Simon ..... 280/14.22
6,270,096 B1 8/2001 Cook
6,386,561 B1 * 5/2002 Hanson ..... 280/87.042
6,409,184 B1 * 6/2002 Giannini ..... 280/11.233
6,428,022 B1 * 8/2002 Namiki ..... 280/87.042
6,431,568 B1 * 8/2002 McCleese ..... 280/87.042
6,435,529 B1 * 8/2002 Stewart et al. ..... 280/87.041
6,508,335 B2 * 1/2003 Zinanti ..... 280/843
6,616,583 B1 * 9/2003 Stack ..... 482/146

* cited by examiner

*Primary Examiner*—Hau Phan

(57) ABSTRACT

An inline skateboard assembly for providing a challenging sport activity includes a generally planar elongated board and multiple rollers coupled inline to an underside of the board. A single or multiple frictional brake members are coupled to the underside of the board.

13 Claims, 2 Drawing Sheets

INLINE SKATEBOARD ASSEMBLY

CROSS REFERENCE TO RELATED APPLICATION

This application claims the benefit of U.S. Provisional Application No. 60/405,029, filed Aug. 21, 2002.

BACKGROUND OF THE INVENTION

1. Field of the Invention

The present invention relates to skateboards and more particularly pertains to a new inline skateboard assembly for providing a challenging sport activity.

2. Description of the Prior Art

The use of skateboards is known in the prior art. U.S. Pat. No. 5,419,570 describes a handled skateboard having a single roller set of aligned rollers. Another type of skateboard is U.S. Pat. No. 5,601,299 also having a single roller set of aligned rollers. U.S. Pat. No. 6,270,096 discloses a skateboard having a fixed roller set and a pivoting roller set for steering the skateboard.

SUMMARY OF THE INVENTION

The present invention provides a board having two fixed roller sets, upwardly turned ends, and a brake member fixedly attached to an end of one of the roller sets.

An object of the present invention is to provide a new inline skateboard assembly that is generally symmetrical front to back for facilitating flipping of the board back to front during use.

Another object of the present invention is to provide a new inline skateboard assembly that is without handles and is intended to be used alone to increase the required coordination and skill necessary to ride the skateboard.

To this end, the present invention generally comprises a board having fixed position multiple roller sets.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

The objects of the invention, along with the various features of novelty which characterize the invention, are pointed out with particularity in the claims annexed to and forming a part of this disclosure.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF A PREFERRED EMBODIMENT

Figure 1:
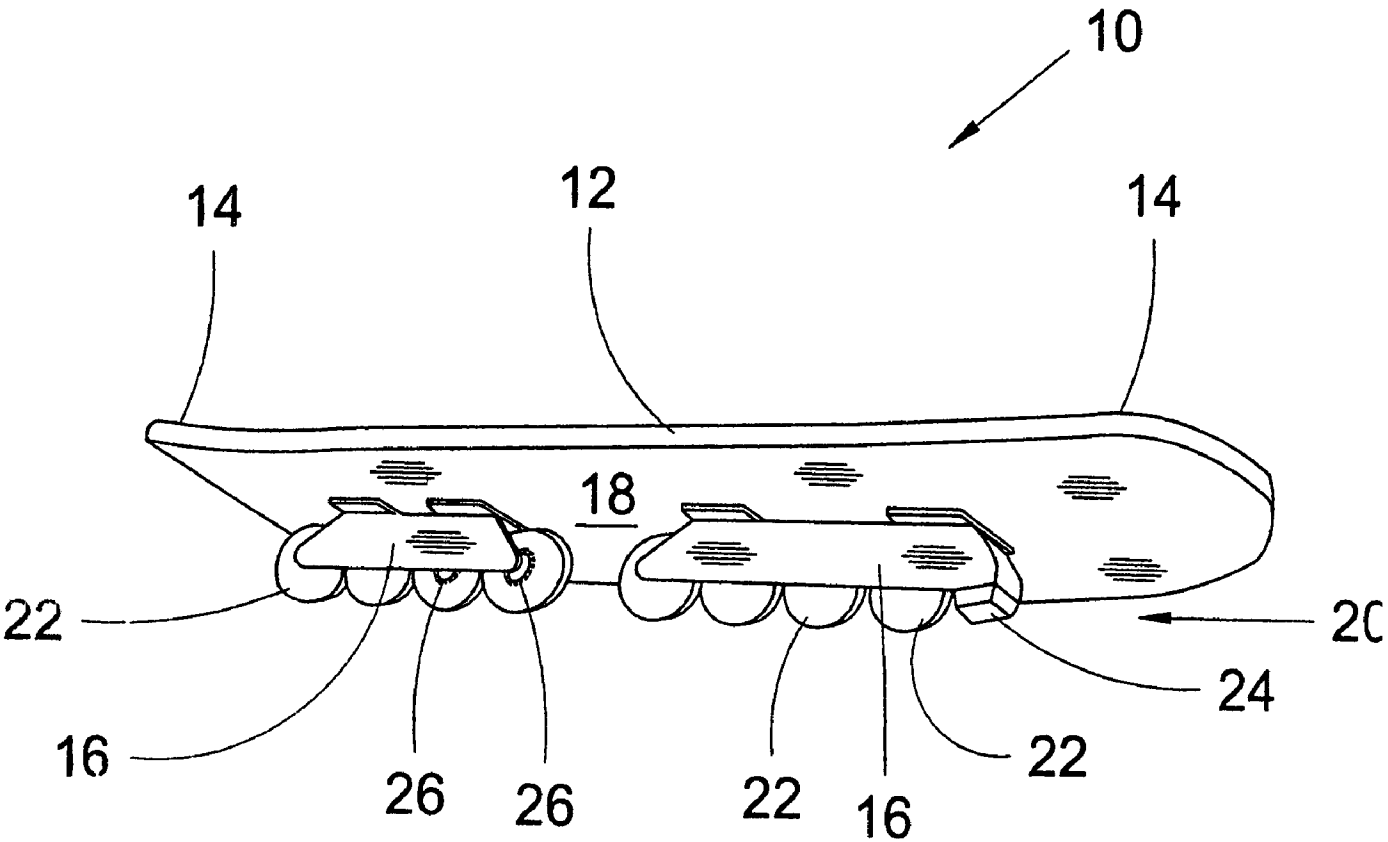
FIG. 1 is a rear underside perspective view of a new inline skateboard assembly according to the present invention.
Figure 2:
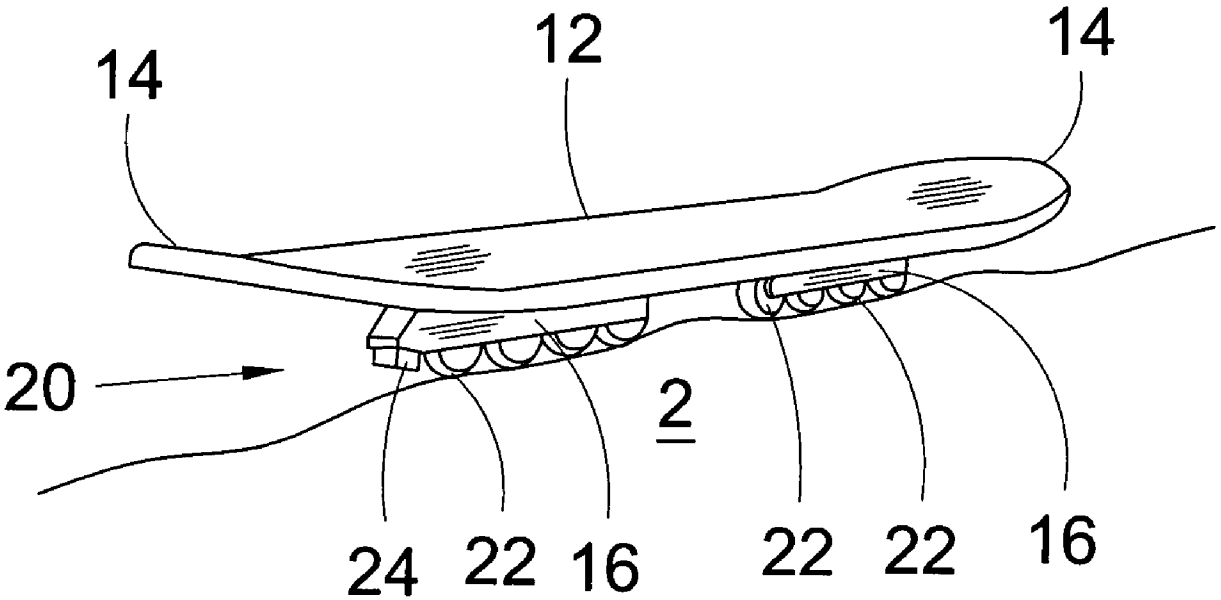
FIG. 2 is a rear topside perspective view of the present invention.

With reference now to the drawings, and in particular to FIGS. 1 and 2, a new inline skateboard assembly embodying the principles and concepts of the present invention will be described.

As illustrated in FIGS. 1 and 2, the inline skateboard assembly 10 generally comprises a generally planar elongated board 12 having upwardly turned ends 14. Two spaced roller sets 16 having rollers 22 are coupled to the underside 18 of the board 12 to form a line of rollers 20 to allow the board 12 to move backward and forward along the line of the roller sets 16. Typically, the rollers 22 are aligned with a longitudinal axis passing through a center of the board 12. A brake member 24 is positioned adjacent to one or both of the roller sets 16 such that pivoting the board 12 on one of the outermost rollers 22 brings the brake member 24 into contact with a supporting surface 2 to bring the board 12 to a stop using friction between the brake member 24 and the supporting surface 2. The roller sets 16 are also positioned symmetrically about a central transverse axis of the board 12.

In a particular embodiment, the board 12 measures 31 inches long by 8 inches wide. The rollers 22 position the board 12 approximately 4 inches above the supporting surface 2. The board 12 is octagonally shaped and constructed of wood, fiberglass, or durable plastic material. Eight rollers 22 are utilized and are constructed of durable polyurethane and include internal ball bearing sets 26. The rollers 22 are typically of a greater radius than those used on common skateboards and thus absorb more road shock and can permit faster moving of the board while riding.

In use, the board is mounted by a rider and used similar to the use of common skateboards except that the inline positioning of the rollers and the positioning of the brake or brakes alters the required balance and coordination to successfully ride the board.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. An inline skateboard assembly comprising:

a generally planar elongated board having opposite forward and rearward ends, said board having lateral side edges, said board being continuous between said ends, at least one of said ends being upwardly turned; and a plurality of roller sets, each roller set having a plurality of rollers, wherein each roller set is fixedly coupled to an underside of said board to form a line of roller sets to allow said board to move backward and forward along a longitudinal axis of said aligned roller sets;

wherein the plurality of roller sets are longitudinally separated and spaced from each other toward said ends of said board;

wherein said plurality of roller sets are substantially centered between said lateral side edges such that lateral portions of said board edge extend laterally outwardly from said plurality of roller sets;

wherein each of said plurality of roller sets has an outermost roller positioned toward one of the opposite forward and rearward ends of the elongated board, and a brake member positioned adjacent to each of said outermost rollers such that pivoting said elongated board on one of said outermost rollers brings one of said brake members into contact with a supporting surface to bring said board to a stop using friction between said brake member and the supporting surface when said board is moving in a forward or a rearward direction.

2. The inline skateboard assembly of claim 1 wherein said rollers of each roller set are aligned to form a single row of rollers.

3. The inline skateboard assembly of claim 2 wherein said longitudinal axis of said aligned roller sets is vertically aligned with a longitudinal axis passing through a center of said board when said roller sets are in a vertical position.

4. The inline skateboard assembly of claim 1, wherein said elongated board has a top surface, said top surface being substantially free of any securing structure.

5. The inline skateboard assembly of claim 1 wherein said board has a pair of upwardly turned ends.

6. The inline skateboard assembly of claim 1 wherein said board has a length of about 31 inches and a width of about 8 inches.

7. The inline skateboard assembly of claim 1 wherein said roller sets each have a height to position said board approximately 4 inches above a supporting surface.

8. The inline skateboard assembly of claim 1 wherein said board is substantially octagonal.

9. The inline skateboard assembly of claim 1 wherein said board is constructed of a material chosen from the group of materials consisting of wood, fiberglass, and plastic.

10. The inline skateboard of claim 1 wherein said roller sets have a cumulative total of eight said rollers.

11. The inline skateboard of claim 1 wherein each of said rollers is constructed of polyurethane.

12. The inline skateboard assembly of claim 1 wherein each said roller includes an internal set of ball bearings.

13. The inline skateboard assembly of claim 1 wherein said rollers of each roller set are aligned to form a single row of rollers;

wherein said longitudinal axis of said aligned roller sets is vertically aligned with a longitudinal axis passing through a center of said board when said roller sets are in a vertical position;

wherein said elongated board has a top surface, said top surface being substantially free of any securing structure;

wherein said board has a pair of upwardly turned ends;

wherein said board has a length of about 31 inches and a width of about 8 inches; and wherein said roller sets each have a height to position said board approximately 4 inches above a supporting surface.

* * * * *